US005972194A

United States Patent [19]

Schepers et al.

[11] Patent Number: 5,972,194

[45] Date of Patent: Oct. 26, 1999

[54] PROCESS FOR PRODUCING A BASE MOLD FOR ELECTROLYTICALLY PRODUCING SEAMLESS ROTARY SCREEN PRINTING STENCILS

[76] Inventors: Hans-Georg Schepers, Wüllener Strasse 60; Karl-Wilhelm Saueressig, Gutenbergstrasse 1-3, both of Vreden D-48691, Germany

[21] Appl. No.: 08/535,131

[22] PCT Filed: Feb. 9, 1995

[86] PCT No.: PCT/EP95/00458

§ 371 Date: Sep. 20, 1996

§ 102(e) Date: Sep. 20, 1996

[87] PCT Pub. No.: WO95/21951

PCT Pub. Date: Aug. 17, 1995

[30] Foreign Application Priority Data

Feb. 12, 1994 [DE] Germany ..... 44 04 560

[51] Int. Cl.[6] ..... B41C 3/08

[52] U.S. Cl. ..... 205/127; 205/122

[58] Field of Search ..... 205/127; 430/942

[56] References Cited

U.S. PATENT DOCUMENTS

| | | | |
|---|---|---|---|
| 3,749,010 | 7/1973 | Mentone | 101/127 |
| 3,960,675 | 6/1976 | Motter | 204/25 |
| 4,309,455 | 1/1982 | Miyagawa | 204/17 |
| 4,384,945 | 5/1983 | Sword | 204/181 |
| 4,401,520 | 8/1983 | Steppan et al. | 204/11 |
| 5,328,537 | 7/1994 | Shigeta | 156/233 |
| 5,444,212 | 8/1995 | MacNaughton et al. | 219/121 |
| 5,573,815 | 11/1996 | Cairncross et al. | 427/504 |

FOREIGN PATENT DOCUMENTS

| | | |
|---|---|---|
| 0 030 774 A1 | 12/1980 | European Pat. Off. . |
| 0030774A1 | 12/1980 | European Pat. Off. . |
| 1254944 | 11/1986 | Japan . |
| 0028821 | 1/1989 | Japan . |
| 405127385 | 5/1993 | Japan . |

*Primary Examiner*—Kathryn Gorgos
*Assistant Examiner*—Erica Smith-Hicks
*Attorney, Agent, or Firm*—Hill & Simpson

[57] ABSTRACT

A process for producing a mold for electrolytically producing seamless rotary screen printing stencils is disclosed which includes the steps of: providing a metal mold body having a cylindrical outer surface; covering the outer surface with a sensitive layer such as a photo-sensitive layer, a thermo-sensitive layer or an electrically sensitive layer; exposing predetermined portions of the sensitive layer to a beam which is controlled electronically thereby creating exposed portions of the sensitive layer as well as unexposed portions of the sensitive layer; removing the unexposed portions of the sensitive layer; generating indentations in the metal body at locations where the unexposed portions of the sensitive layer have just been removed; removing the exposed portions of the sensitive layer; and filling the indentations with a non-conductive filler.

15 Claims, 1 Drawing Sheet

PROCESS FOR PRODUCING A BASE MOLD FOR ELECTROLYTICALLY PRODUCING SEAMLESS ROTARY SCREEN PRINTING STENCILS

The invention relates to a process for producing a base mold for electrolytically producing seamless rotary screen printing stencils, in particular of nickel, wherein a metallic mold base member with a cylindrical generated surface is provided at the outer circumference thereof with depressions distributed in a regular grid with the depressions having a round or polygonal contour and in-between grid webs forming a regular net, and wherein subsequently the depressions are filled flush to the height of the grid webs with an electrically non-conductive filling compound, whereafter repeatedly screen printing stencils may be generated by electrolytically coating with metal and axially removing the sleeve thus produced.

In practical experience base molds for the purpose mentioned hitherto have been produced by a roll embossing method. Therein the desired grid of depressions is pressed into the generated surface of the mold base member by a grooved roller. The grooved roller is a relatively small roller being rolled at the circumference of the mold base member along a helix under strong pressure. The grooved roller at the generated surface thereof carries projections in form of the desired grid which produce a negative image of the desired depressions for the mold base.

Disadvantages of the roll embossing method are that it involves lengthy process times, requires high tooling effort and must be performed by highly skilled operators to produce acceptable methods. In particular, it is very difficult, and in fact only possible for an operator with extensive experience, to roll the grooved roller at the generated surface of the mold base member such, that the helix extending along the generated surface of the mold base member as seen in longitudinal and circumferential direction of the mold base member has no offset in the grid image. Furthermore the production of grooved rollers is very costly as extensive steps in mechanical machining are necessary. Each change in the grid requires the production of an adapted grooved roller. A further disadvantage is such, that the material for the mold base member must be relatively soft to enable the desired pressing or rolling of the depressions by the grooved roller. Therefore for practical reasons only copper has been used for mold base members which is provided with a thin chroming at the surface thereof. For raising the stability which is necessary for rolling the grooved roller under high pressure the mold base member furthermore has to have a sturdy steel core which makes the mold base member as such very heavy and therefore difficult to handle and to transport.

The depressions generated by roll embossing may only have the shape of truncated pyramids or cones with relatively flat inclined flanks. This leads to the disadvantage, that the electrically non-conductive filling compounds situated in the depressions are very thin at the edges of the depressions and may break. During the later electrolytical coating of metal on the mold base for shaping the screen printing stencil this may lead to a damage of the surface of the mold base by metal tappets protruding inwardly from the stencil when removing the electrolytically finished stencil with the tappets resulting from broken areas of the filling compound. Since furthermore, the mold base consists of relatively soft copper, in contrast to e.g., nickel as a relatively hard and preferred material for screen printing stencils marks may be produced in the longitudinal direction of the mold base in spite of the chroming however, which is relatively thin, with the marks leading to relatively few production operations with the base mold for producing screen printing stencils.

Processes other than the mechanical roll embossing method for producing base molds for use in forming screen printing stencils are disclosed in EP 0 030 774 A1. As a first known process for producing a mold base member it is disclosed, that the depressions which are to be filled with non-conductive material are generated by etching. It is not disclosed in the document how to proceed with the etching; however, it is obvious for the expert that an etching mask is necessary for this purpose. The document, however, does not disclose anything about producing construction and treating the etching mask. As a second process for producing a mold base the document discloses to directly transfer pocket-like areas of the mold base member into a non-conductive state by a controlled energy beam by thermal impingement. As an example a mold base member consisting of electrically conductive aluminum at the surface thereof is changed by the energy beam into aluminum oxide being electrically non-conductive.

One of the disadvantages of EP 0 030 774 A1 is that the chemical and thermal methods for producing depressions may produce some irregular contours.

It is therefore the object of the instant invention to provide a process of the kind mentioned before which enables the production of a mold base for the electrolytical production of seamless rotary screen printing stencils, in particular of nickel, with a small effort in machinery, personnel and time and with which mold bases with high quality and a long life span may be produced.

According to the invention this object is attained by a process of the kind mentioned before being characterized by the following process steps:

a) the generated surface of the mold base member is coated with a photo, thermo or electrosensitive coating, b) the coating is exposed with the positive or negative image of the desired depression grid by a beam controlled according to electronically stored data, and then removed by a chemical and/or physical removal process, either immediately after exposure or after a development process in the areas in which the depressions are provided, c) the depressions are formed by corrosive attack or electrolytical removal in the areas of the generated surface of the mold base member, from which areas the coating has been removed, d) the remaining parts of the coating are completely removed, and e) the depressions are filled with the electrically non-conductive filling compound.

An alternate embodiment of the process according to the invention provides according to claim 2, that the step b) is accomplished as follows:

b) the coating is directly removed in the areas wherein the depressions are to be provided by a beam controlled according to electronically stored data.

The instant invention does not require the use of rolling tools and devices as does the roll embossing method. As a result, a significant savings is achieved by a reduction in the process time, technical effort, tooling effort and personnel effort. As the shape of the contour of the depressions and the grid wherein these depressions are arranged are now stored electronically, the shape of the contour of the depressions and the distribution thereof within the grid may be produced with high accuracy, and may be changed and adapted to the requirements with little effort without producing roll embossing tools as required in prior art.

By the etching or the electrolytic metal removal the depressions gain a contour which provides an improved fastening of the electrically non-conductive filling compound. The reason is, that the depressions are no longer shaped as truncated pyramids or cones with flat flanks, but gain the shape of oval pockets in the cross-section thereof. As a result the filling compound within the pockets even in the outer areas thereof gains a comparatively high thickness such, that the breaking out of the filling compound is avoided. Accordingly no protruding metal tappets may be formed during the later electrolytic coating of the screen printing stencil leading to a better quality of the screen printing stencil and to avoiding a damage of the mold base when axially removing the stencil. Thereby the mold base gets a higher tool life which in practical experience is twice or three times as long as it has been the case with mold bases of the prior art.

Preferably it is provided, that an ultra-violet laser beam or a thermally effective laser beam or an electronic beam is used as the beam. The beams mentioned may be produced and focused relatively easy such, that in combination with a coating correspondingly selected with the required sensitivity, depressions and grid may be produced with high definition and accuracy and large MESH-numbers.

As a mechanical pressing of the depressions into the mold base member does no longer occur with the process according to the invention, the mold base member must no longer consist of the relatively soft copper, but may consist of a harder metal, preferably nickel. The metal nickel offers the advantage of a high hardness, a high strength and a high density of structure. Furthermore it provides a good electrical conductivity and may be well electrolytically coated. Thereby a chroming of the surface of the mold base may be deleted which facilitates the recycling of mold bases no longer usable. A further advantage to be gained by using nickel as a material for the mold base is, that the nickel surface of the mold base is self-protective by the formation of a layer of nickel oxide being electrically conductive thoughout. Furthermore this layer of nickel oxide provides, that the screen printing stencil electrolytically coated on the mold base may easily be removed from the mold base, as the layer of nickel oxide at the mold base serves as a separating agent.

In order to save material and decrease weight a hollow cylindrical nickel sleeve maybe used as a mold base member. This is possible as the mold base member is not required to have a particularly high mechanical stability because there are no longer any mechanical pressure forces between a grooved roller and the mold base member. Furthermore the use of a hollow cylindrical nickel sleeve allows easier handling and an easier and cheaper transport between the producer of the mold base and the producer of screen printing stencils especially when the end user of the base mold and producer are not the same.

As an electrically non-conductive filling compound preferably a curable synthetic resin or a curable ceramic compound is used. These materials offer the advantage, that on the one hand they may be inserted into the depressions as a mass being still viscouse, and that on the other hand after the curing they stick very firmly to the depressions and provide a high strength and surface quality. Particularly these materials after the curing thereof may be machined by mechanical processes, e.g. turning or grinding, without falling out of the pockets or breaking at the brim of the depressions.

The depressions are preferably generated with a regular hexagonal contour; furthermore the depressions are preferably arranged like a honeycomb in a hexagonal grid. This offers the advantage, that the screen printing stencils produced on this mold base have a high strength and stability and a low weight and a good ratio between webs and apertures. Because of the electronic storage of the shape of the contour of the depressions and their distribution in a grid all freedom is given when designing these parameters.

BRIEF DESCRIPTION OF DRAWINGS

In the following an example of the process according to the invention is explained referring to a drawing. The FIGS. 1 to 5 of the drawing illustrate a section of the circumferential area of a mold base member during various process steps; the FIG. 6 of the drawing illustrates a section of the circumferential area of a finished mold base.

DETAILED DESCRIPTION OF DRAWINGS

Figure 1:
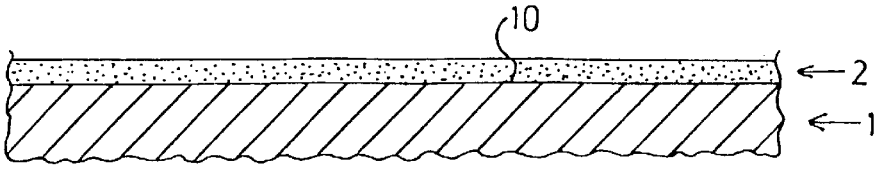

According to FIG. 1 the mold base member 1 consists of metal and comprises a cylindrical generated surface 10. The mold base member 1 may also be designed as a cylinder or a hollow cylindrical sleeve.

A sensitive coating 2 in form of a comparatively thin layer is coated onto the generated surface 10 of the mold base member 1 with the coating being illustrated exaggeratedly thick in the figure. This coating 2 may be a photo, thermo or electrosensitive material which is known as such. Also the coating processes for such layers for producing an equally thick layer are known and need not be explained here.

Figure 2:
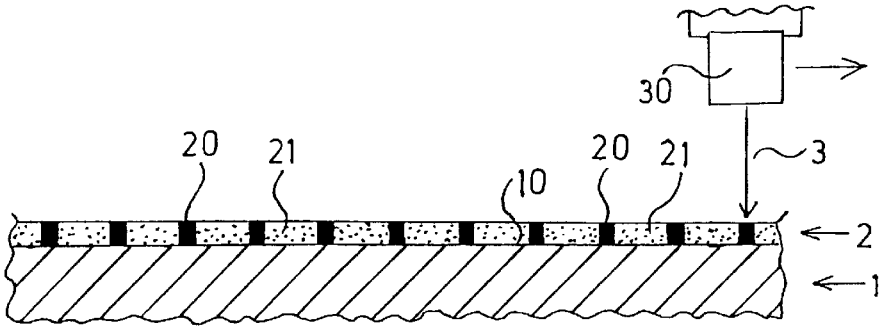

FIG. 2 of the drawing illustrates the mold base member 1 during a process step in which by a laser 30, which emits a controlled laser beam 3 an exposure of the sensitive layer 2 is accomplished, in this case with a negative image of the desired depressions. During this process the mold base member 1 and the laser 30 are moved in two directions in relation to each other, preferably in axial direction and circumferential direction such that the complete surface area of the mold base member 1 is stepwise scanned. During this movement in relation to each other the beam 3 is energized and de-energized according to electronically stored data in order to expose the positive or negative image of a desired grid onto the layer 2, depending on the fact, whether this layer reacts photo-positive or photo-negative. In the given case illustrated in the drawing the coating 2 is changed by the exposure in the areas 20 such that it becomes insoluble for the subsequent chemical and/or physical removal process. Between the exposed areas 20 non-exposed area 21 will remain corresponding to the areas in which furtheron depressions are to be generated in the mold base member 1.

Figure 3:
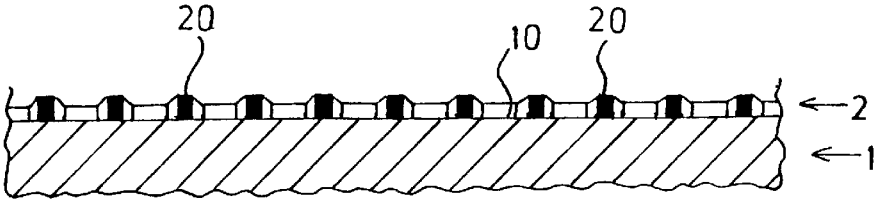

FIG. 3 of the drawing illustrates the mold base member 1 after the removal process in which the non-exposed areas 21 of the coating 2 have been removed. Now only the exposed areas 20 will remain of the coating 2 on the generated surface 10 with the areas 20 forming a net like grid of outwards protruding webs each including regular hexagons.

Figure 4:
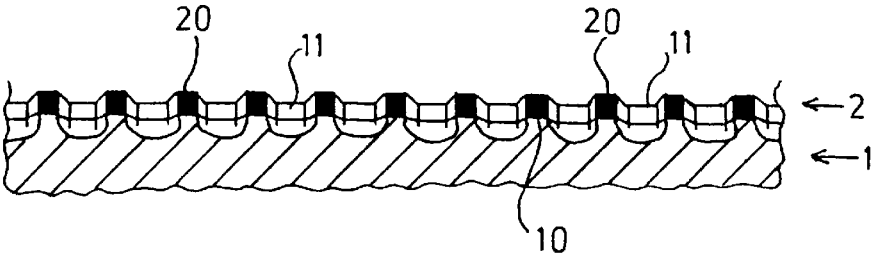

In FIG. 4 of the drawing the mold base member is illustrated after passing through an etching bath or an electrolytical removal process. By this etching or electrolytical removal, metal is removed from the mold base member 1 in those areas, where the etching acid or the electrolytical liquid has no access to the generated surface 10. Underneath the areas 20 of the coating 2 the acid or the electrolytical liquid have no access to the generated surface 10 of the mold base member 1 such, that no metal removal occurs there.

Figure 5:
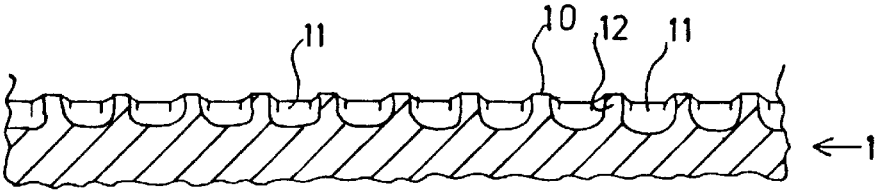

In a further process step the remaining part 20 of the coating 2 is also removed by a suitable removing process, whereafter the mold base member has the surface form illustrated in FIG. 5. This is characterized by a grid of depressions 11 having hexagonal contours with net like distributed webs 12 in between. The outer surface of the webs 12 corresponds with the generated surface 10 of the mold base member 1.

Figure 6:
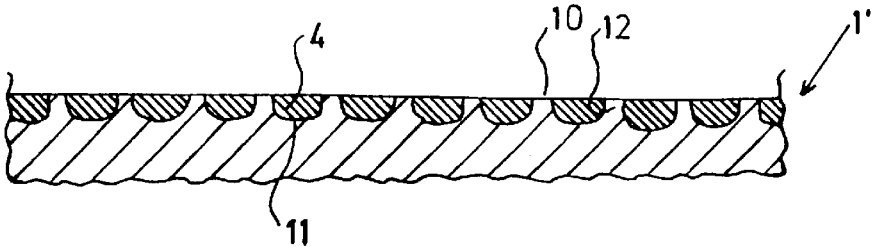

Finally FIG. 6 of the drawing illustrates the finished mold base 1' wherein now the depressions 11 are completely filled up are filled flush with the generated surface 10 of the mold base member 1. Hereby areas with different electric characteristics are shaped on the generated surface 10 of the mold base 1' in the desired distribution, namely electrically non-conductive areas in the area of the surface of the filling compound 4, and electrical conductive areas in the area of the surface of the webs 12.

The finished mold base 1' now may be used in a manner known as such for the electrolytical production of seamless rotary screen printing stencils in repeated process steps, wherein in the area of the electrical conductive webs 12 at the generated surface 10 of the mold base 1' metal is electrolytically deposited until the desired thickness of the coating is attained. This screen printing stencil sleeve generated in this way may then be removed in axial direction from the mold base 1', i.e. parallel to the generated surface 10.

We claim:

1. A process for producing a mold for electrolytically producing seamless rotary screen printing stencils, the process comprising the following steps:

providing a metal mold body having a cylindrical outer surface;

covering the outer surface of the metal mold body with a sensitive layer selected from the group consisting of a photo-sensitive layer, a thermo-sensitive layer and an electrically sensitive layer;

exposing predetermined portions of the sensitive layer to a beam which is controlled electronically by a controller having a memory with a grid stored therein, thereby creating exposed portions of the sensitive layer as well as leaving unexposed portions of the sensitive layer;

removing the unexposed portions of the sensitive layer by a process selected from the group consisting of physically removing the unexposed portions and chemically removing the unexposed portions;

generating indentations in the metal mold body at predetermined areas where the unexposed portions have been removed by a process selected from the group consisting of etching and electrolytical metal removing;

removing the exposed portions of the sensitive layer; and filling the indentations with a non-conductive filler.

2. The process of claim 1 wherein the step of removing the unexposed portions consists of physically removing the unexposed portions with an energized beam that is controlled electronically by the controller.

3. The process of claim 1 wherein the beam is selected from the group consisting of an ultra-violet laser beam, a thermally acting laser beam and an electronic beam.

4. The process of claim 1 wherein the metal mold body comprises a cylindrical nickel sleeve.

5. The process of claim 1 wherein the metal mold body comprises a hollow nickel cylinder.

6. The process of claim 1 wherein the filler is selected from the group consisting of a curable synthetic resin and a curable ceramic material.

7. The process of claim 1 wherein the indentations have a profile corresponding to one-half of a regular hexagon.

8. A process for producing a mold for electrolytically producing seamless rotary screen printing stencils, the process comprising the following steps:

providing a metal mold body having a cylindrical outer surface;

covering the outer surface of the metal mold body with a sensitive layer selected from the group consisting of a photo-sensitive layer, a thermo-sensitive layer and an electrically sensitive layer;

exposing predetermined portions of the sensitive layer to a beam which is controlled electronically by a controller having a memory with a grid pattern stored therein, thereby creating exposed portions of the sensitive layer as well as leaving unexposed portions of the sensitive layer;

removing the unexposed portions of the sensitive layer thereby leaving exposed portions of the metal mold body where the unexposed portions have been removed;

generating indentations in the exposed portions of the metal mold body;

removing the exposed portions of the sensitive layer;

filling the indentations with a non-conductive filler.

9. The process of claim 8 wherein the step of removing the unexposed portions is carried out with a process selected from the group consisting of physically removing the unexposed portions and chemically removing the unexposed portions.

10. The process of claim 8 wherein step of generating the indentations at the exposed areas of the metal body is carried out using a process selected from the group consisting of etching and electrolytical metal removing.

11. The process of claim 8 wherein the step of removing the unexposed portions consists of physically removing the unexposed portions with an energized beam that is controlled electronically by the controller.

12. The process of claim 8 wherein the beam is selected from the group consisting of an ultra-violet laser beam, a thermally acting laser beam and an electronic beam.

13. The process of claim 8 wherein the metal mold body comprises a cylindrical nickel sleeve.

14. The process of claim 8 wherein the metal mold body comprises a hollow nickel cylinder.

15. The process of claim 8 wherein the filler is selected from the group consisting of a curable synthetic resin and a curable ceramic material.

* * * * *